US008620202B2

(12) United States Patent
Kimura et al.

(10) Patent No.: US 8,620,202 B2
(45) Date of Patent: Dec. 31, 2013

(54) FIXING MEMBER COMPRISING RESILIENT LAYER INCLUDING INCLINED PORTION, FIXING DEVICE AND IMAGE FORMING DEVICE

(75) Inventors: Jun Kimura, Kanagawa (JP); Shigehito Ando, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 311 days.

(21) Appl. No.: 12/853,808

(22) Filed: Aug. 10, 2010

(65) Prior Publication Data

US 2011/0176844 A1 Jul. 21, 2011

(30) Foreign Application Priority Data

Jan. 18, 2010 (JP) ..... 2010-008452

(51) Int. Cl.
*G03G 15/20* (2006.01)

(52) U.S. Cl.
USPC ..... 399/333

(58) Field of Classification Search
USPC ..... 399/328, 330, 331, 333, 339
See application file for complete search history.

(56) References Cited

U.S. PATENT DOCUMENTS

| | | | | |
|---|---|---|---|---|
| 4,045,134 | A * | 8/1977 | Suzuki et al. | 399/159 |
| 7,974,563 | B2 * | 7/2011 | Sakai et al. | 399/333 |
| 2002/0114642 | A1 * | 8/2002 | Rimai et al. | 399/167 |
| 2003/0113142 | A1 * | 6/2003 | Yoda et al. | 399/325 |
| 2005/0185996 | A1 * | 8/2005 | Oishi et al. | 399/329 |
| 2007/0175056 | A1 * | 8/2007 | Tran et al. | 33/451 |
| 2008/0112741 | A1 * | 5/2008 | Nakajima | 399/333 |
| 2008/0118283 | A1 * | 5/2008 | Tsueda et al. | 399/333 |
| 2009/0003900 | A1 * | 1/2009 | Shimizu et al. | 399/329 |
| 2009/0285610 | A1 * | 11/2009 | Edahiro | 399/329 |

FOREIGN PATENT DOCUMENTS

| | | | |
|---|---|---|---|
| JP | 05006120 | A * | 1/1993 |
| JP | A-05-006120 | | 1/1993 |
| JP | 2000338810 | A * | 12/2000 |
| JP | 2002139936 | A * | 5/2002 |
| JP | A-2005-070272 | | 3/2005 |

* cited by examiner

*Primary Examiner* — David Gray
*Assistant Examiner* — Tyler Hardman
(74) *Attorney, Agent, or Firm* — Oliff & Berridge, PLC

(57) ABSTRACT

There is provided a fixing member to be used in a pressured state, the fixing member including: a base member that is rotated; a resilient layer that is formed on an outer periphery of the base member; and a surface layer that is formed on an outer periphery of the resilient layer, wherein an axial direction end face of the resilient layer includes an inclined portion that is inclined such that an axial direction length thereof is longer at the base member side than at the surface layer side, and that is exposed in the axial direction.

19 Claims, 6 Drawing Sheets

FIXING MEMBER COMPRISING RESILIENT LAYER INCLUDING INCLINED PORTION, FIXING DEVICE AND IMAGE FORMING DEVICE

CROSS-REFERENCE TO RELATED APPLICATION

This application is based on and claims priority under 35 USC 119 from Japanese Patent Application No. 2010-8452 filed Jan. 18, 2010.

BACKGROUND

Technical Field

The present invention relates to a fixing member, a fixing device and an image forming device.

SUMMARY

According to an aspect of the invention, there is provided a fixing member to be used in a pressured state, the fixing member including:

a base member that is rotated;

a resilient layer that is formed on an outer periphery of the base member; and a surface layer that is formed on an outer periphery of the resilient layer, wherein an axial direction end face of the resilient layer includes an inclined portion that is inclined such that an axial direction length thereof is longer at the base member side than at the surface layer side, and that is exposed in the axial direction.

BRIEF DESCRIPTION OF THE DRAWINGS

Exemplary embodiments of the present invention will be described in detail based on the following figures, wherein.

DETAILED DESCRIPTION

Examples of a fixing member, a fixing device and an image forming device relating to an exemplary embodiment of the present invention will be described.

Figure 1:
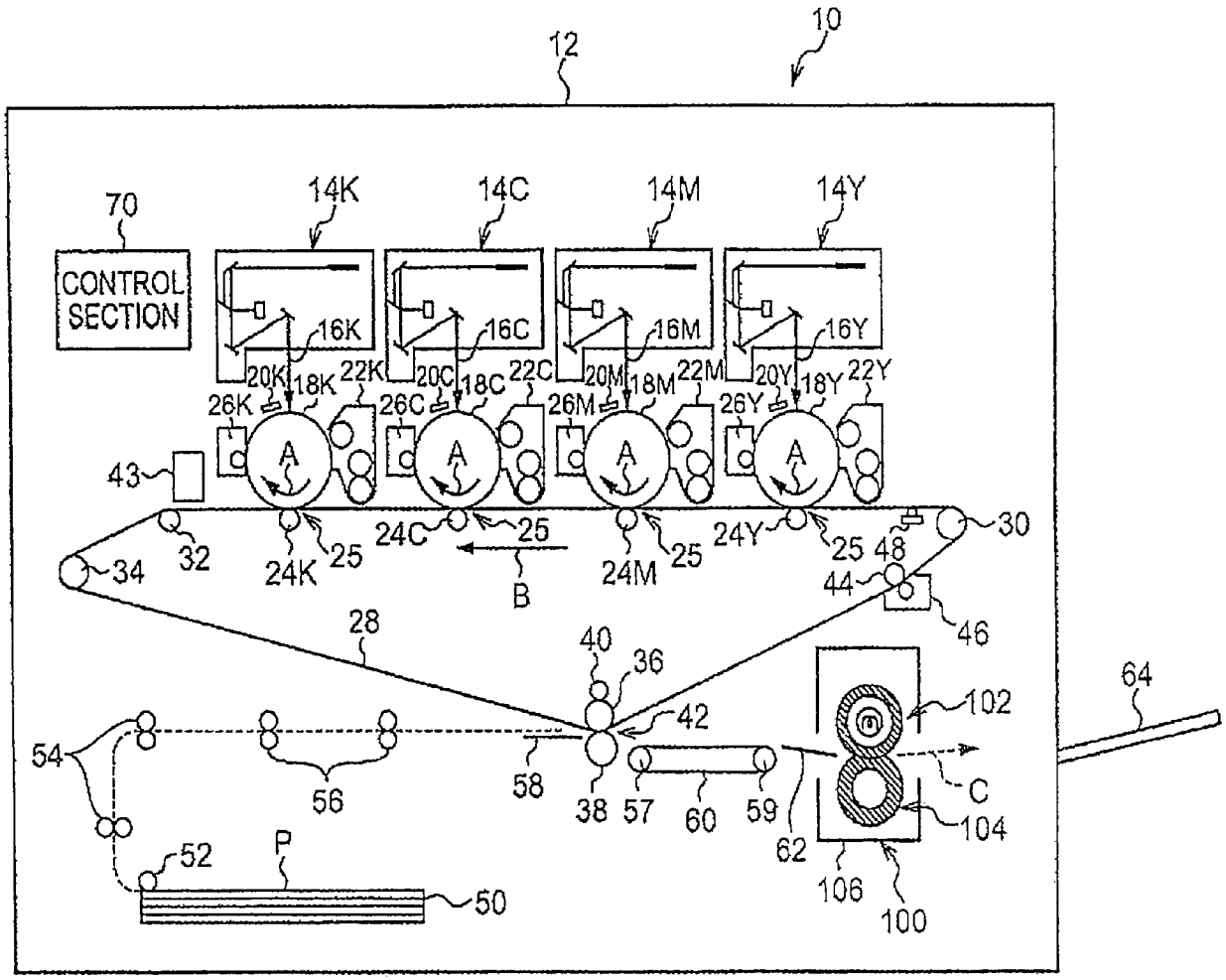
FIG. 1 is an overall diagram of an image forming device relating to an exemplary embodiment of the present invention.

FIG. 1 illustrates an image forming device 10. In the image forming device 10, optical scanning devices 14Y, 14M, 14C and 14K that emit light beams 16 corresponding to respective toilers (developing agents) of yellow (Y), magenta (M), cyan (C) and black (K) are fixed inside a casing 12 that structures the main body of the image forming device 10. A control section 70 that controls operations of each section of the image forming device 10 is provided at a position adjacent to the optical scanning device 14K (to the left side in the drawing). In the following descriptions, where it is necessary to distinguish between Y, M, C and K, description is given with one of the letters Y, M, C and K appended to the reference numerals. Where structures are the same and it is not necessary to distinguish between Y, M, C and K, references to Y, M, C and K are omitted.

The optical scanning device 14 is configured to scan a light beam emitted from a light source with an unillustrated rotating multi-surface mirror (a polygon mirror) and to reflect the light beam with plural optical elements, including a reflecting mirror, and emit the light beams 16 to correspond with the respective toners. At the lower side of each optical scanning device 14, a respective photoreceptor 18 is provided in correspondence with the optical scanning device 14.

The photoreceptor 18 is turned in the direction of arrow A (the clockwise direction in the drawing) by a driver structured with an unillustrated motor and gears. The light beams 16 emitted from the optical scanning device 14 are guided to each corresponding photoreceptor 18. At an upstream side in the turning direction (the direction of arrow A), an electrostatic charger 20 that charges up the surface (outer peripheral surface) of the photoreceptor 18 is disposed at a location opposing the surface of the photoreceptor 18.

A developer 22 is disposed at the downstream side relative to the electrostatic charger 20 in the turning direction of the photoreceptor 18. The developer 22 develops an electrostatic latent image on the photoreceptor 18, which has been formed by charging by the electrostatic charger 20 and exposure by the optical scanning device 14, with the respective toner. An intermediate transfer belt 28 is disposed at the downstream side relative to the developer 22 in the turning direction of the photoreceptor 18, onto which the toner image developed by the developer 22 is first-transferred. The intermediate transfer belt 28 is structured by, for example, a film-form endless belt, in which a suitable amount of an antistatic agent such as carbon black or the like is contained in a resin, such as a polyimide or a polyimide.

A first transfer roller 24 is disposed at the inner side of the intermediate transfer belt 28 at a position at which the photoreceptor 18 and the intermediate transfer belt 28 are opposed. The first transfer roller 24 transfers the toner image formed on the photoreceptor 18 onto the intermediate transfer belt 28. A first transfer section 25 that performs the first transfer from the photoreceptor 18 onto the intermediate transfer belt 28 is constituted by this first transfer roller 24.

The first transfer roller 24 includes an unillustrated shaft and a sponge layer, which serves as a resilient layer, fixed around the shaft. The shaft is, for example, a cylindrical rod structured of a metal such as steel or SUS steel. The sponge layer is formed of, for example, a rubber into which carbon black (a conductive agent) is mixed.

The first transfer roller 24 touches against the photoreceptor 18, sandwiching the intermediate transfer belt 28. A voltage of a polarity opposite to a charging polarity of the toners is applied to the first transfer roller 24 by an unillustrated voltage applier. Thus, the toner images on the photoreceptors 18Y, 18M, 18C and 18K are electrostatically attracted onto the intermediate transfer belt 28 sequentially, and a superimposed toner image is formed on the intermediate transfer belt 28. At the downstream side relative to the first transfer roller 24 in the turning direction of the photoreceptor 18, a cleaner 26 that removes residual toner on the photoreceptor 18 after the first transfer is provided.

A driving roller 30 and a support roller 32 are provided at the inner side of the intermediate transfer belt 28. The driving roller 30 is driven by a motor (not shown) and causes the intermediate transfer belt 28 to move. The support roller 32 extends substantially linearly in the direction in which the photoreceptors 18Y, 18M, 18C and 18K are disposed and supports the intermediate transfer belt 28. With this structure, the intermediate transfer belt 28 is moved to turn in the direction of arrow B.

An assist roller 34 is also provided at the inner side of the intermediate transfer belt 28. The assist roller 34 applies tension to the intermediate transfer belt 28 and prevents meandering of the intermediate transfer belt 28. Further, a second transfer section 42 is disposed at the downstream side in the direction of movement of the intermediate transfer belt 28. The second transfer section 42 transfers the toner image on the intermediate transfer belt 28 onto recording paper P.

The second transfer section 42 is structured by a second transfer roller 38 and a support roller 36. The second transfer roller 38 is disposed at a toner image-bearing face side of the intermediate transfer belt 28, and the support roller 36 is disposed at a rear face side of the intermediate transfer belt 28. The second transfer roller 38 has a layer structure and materials similar to the first transfer roller 24. The second transfer roller 38 is disposed to touch against the support roller 36 so as to sandwich the intermediate transfer belt 28 with the support roller 36.

The support roller 36 forms an opposite pole to the second transfer roller 38. An electricity supply roller 40 made of metal is disposed to touch against the support roller 36, and a second transfer bias is applied through the electricity supply roller 40. The second transfer roller 38 is earthed and the second transfer bias is applied between the second transfer roller 38 and the support roller 36. Thus, the toner image on the intermediate transfer belt 28 is second-transferred onto the recording paper P being conveyed by the second transfer section 42.

An intermediate transfer belt cleaner 46 is disposed at the downstream side relative to the second transfer section 42 in the direction of movement of the intermediate transfer belt 28. The intermediate transfer belt cleaner 46 is provided to be movable toward and away from the intermediate transfer belt 28. The intermediate transfer belt cleaner 46 removes residual toner, paper dust and the like on the intermediate transfer belt 28 after the second transfer. A support roller 44 is provided at the intermediate transfer belt cleaner 46, at the inner side of the intermediate transfer belt 28. A position sensor 48 is disposed at a location that is at the upstream side relative to the first transfer roller 24Y in the direction of movement of the intermediate transfer belt 28 and that is at the inner side of the intermediate transfer belt 28. The position sensor 48 generates a reference signal for matching timings of image formation with the respective toners.

The position sensor 48 detects reflected light from detection marks (not shown) provided at the rear face of the intermediate transfer belt 28 and generates the reference signal. On the basis of this reference signal, the control section 70 operates the respective sections of the image forming device 10 and starts image formation. At the downstream side of the first transfer roller 24K, at the outer side of the intermediate transfer belt 28, an image density sensor 43 for adjusting image quality is provided.

A paper accommodation section 50 that accommodates the recording paper P is disposed at the lower side of the image forming device 10. A feed roller 52 is disposed at one end of the paper accommodation section 50 (the side at which the recording paper P is fed out). The feed roller 52 feeds out and conveys the recording paper P at specified timings. Plural conveyance rollers 54 and 56 are provided above the feed roller 52. The conveyance rollers 54 and 56 are driven to turn by a driver (not shown) including a motor and gears, and convey the recording paper P fed out by the feed roller 52 to the second transfer section 42. A conveyance section 58 is disposed at the downstream side of the conveyance rollers 56 in the direction of conveyance of the recording paper P. The conveyance section 58 feeds the recording paper into the second transfer section 42.

A conveyance belt 60 is provided in the direction of feeding of the recording paper P at the second transfer section 42. The conveyance belt 60 conveys the recording paper P onto which the second transfer of the toner image has been completed to a fixing device 100, which is described below. The conveyance belt 60 is provided to be turningly movable by a support roller 57, a driving roller 59, and an unillustrated driver including a motor and gears. A guide 62 is disposed at an entry aperture side of the fixing device 100. The guide 62 guides the recording paper P into the fixing device 100. A paper stacking section 64 is provided at an exit aperture side of the fixing device 100. The paper stacking section 64 is fixed to the casing 12 of the image forming device 10.

Next, the fixing device 100 is described.

Figure 2:
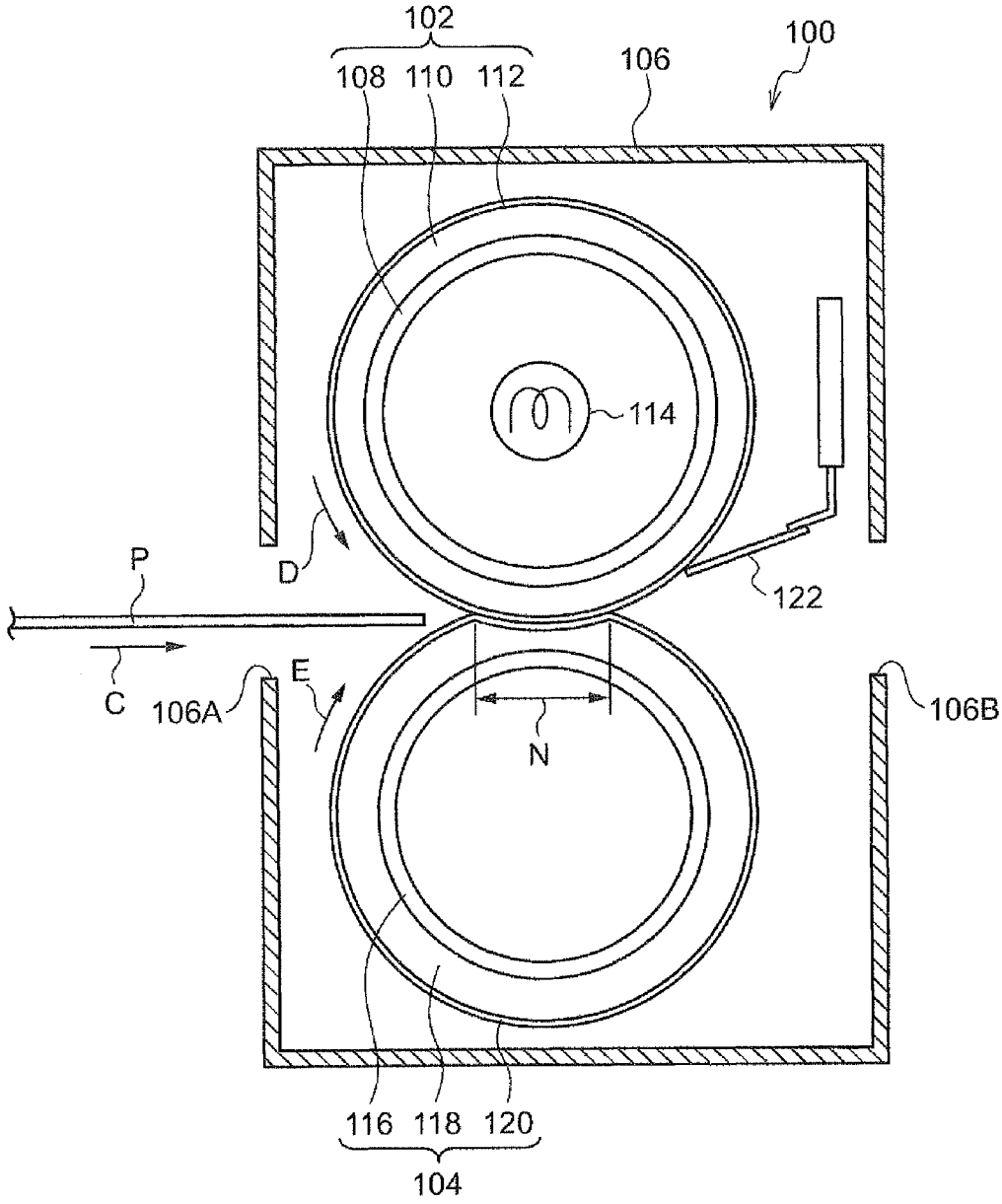
FIG. 2 is a structural diagram of a fixing device relating to the exemplary embodiment of the present invention.

As illustrated in FIG. 2, the fixing device 100 includes a casing 106 in which an aperture portion 106A, into which the recording paper P enters, and an aperture portion 10613, from which the recording paper P is ejected, are formed. A fixing roller 102 is disposed at the upper interior of the casing 106. The fixing roller 102 is supported to be turnable in the direction of arrow D (the anticlockwise direction in the drawing). A pressure roller 104 is disposed at the lower interior of the casing 106. The pressure roller 104, which serves as an example of a fixing member, is supported to be turnable in the direction of arrow E (the clockwise direction in the drawing). The fixing roller 102 and the pressure roller 104 have axial directions thereof aligned, and the outer peripheral faces thereof touch to form a contact portion N (a nipping portion).

The fixing roller 102 has a structure in which a metal core 108, a resilient layer 110 and a surface layer 112 are layered in this order from the inner side to the outer side, and are made integral. As an example, the metal core 108 is a tubular member made of aluminium, the resilient layer 110 is made of silicone rubber, and the surface layer 112 is made of a fluorine-based resin. At the inside of the metal core 108, a halogen heater 114 is provided, which conducts electricity from the control section 70 (see FIG. 1) and generates heat. A plate-form separation member 122 is disposed at a location that is at the recording paper P ejection side of the contact portion N and that is close to the outer peripheral surface of the fixing roller 102. The separation member 122 is for pulling the recording paper P apart from the outer peripheral surface of the fixing roller 102.

The pressure roller 104 has a structure in which a metal core 116, which is an example of a base member, and a resilient layer 118 and a surface layer 120 are layered in this order from the inner side toward the outer side, and are made integral.

The metal core 116 is structured by, for example, a tubular member made of aluminium. As other examples of the metal core 116, metals such as steel, SUS steel and the like may be used. Furthermore, non-metallic materials may be used. For example, resins with heat resistance, such as polyphenylene sulfides, polyimides, polyesters, polyamides, liquid crystal polymers and the like, materials in which glass fibers or the like are added to these resins for reinforcement, and the like may be used.

The resilient layer 118 is formed on the metal core 116 and is adhered to the metal core 116. The resilient layer 118 uses a material such as a silicone rubber, fluorine-based rubber or the like with a durometer hardness of at least A10 and at most A50 (Japanese Industrial Standards (JIS) K6253). Beside these, materials with small permanent compression set characteristics specified in JIS K6262 and materials with large rebound elastic moduluses specified in JIS K6255 are used. As an example, silicone rubber is used.

The surface layer 120 is formed on the resilient layer 118 and is adhered to the resilient layer 118. The surface layer 120 is formed of, for example, a fluorine-based resin containing carbon. The surface layer 120 has a high resiliency, at least 10 times that of the resilient layer 118. The carbon that is contained in the surface layer 120 is preferably a carbon black such as ketjen black, acetylene black or the like. Other conductive agents may also be contained in the surface layer 120. Examples of other conductive agents include metals such as aluminium, nickel and the like, metal oxide compounds such as zinc oxide and the like, and potassium titanate and the like. A volume resistance value of the surface layer 120 is preferably at least 4 log Ω·cm and at most 10 log Ω·cm, and is more preferably at least 4 log Ω·cm and at most 7 log Ω·cm. When the volume resistance is in this range, conductivity of the surface layer 120 may be assured, problems due to static electricity are unlikely to arise, and the endurance of the pressure roller 104 is excellent. The volume resistance is measured using a two-ring electrode method.

The thickness of the resilient layer 118 is set to, for example, at least 10 mm and at most 15 mm, and here is 10 mm. The thickness of the surface layer 120 is set to, for example, at least 50 μm and at most 150 μm, and here is 100 μm. The thickness of the resilient layer 118 should be at least 10 mm because, to deal with an increase in speed of the image forming device 10, a width of the contact portion N needs to be larger in order to assure a heat amount that is to be provided to the toners in a shorter duration, and a deformation amount of the resilient layer 118 needs to be larger. In order to form the contact portion N, the resilient layer 118 is deformed by, for example, 10% to 20% in the radial direction.

Figure 3A:
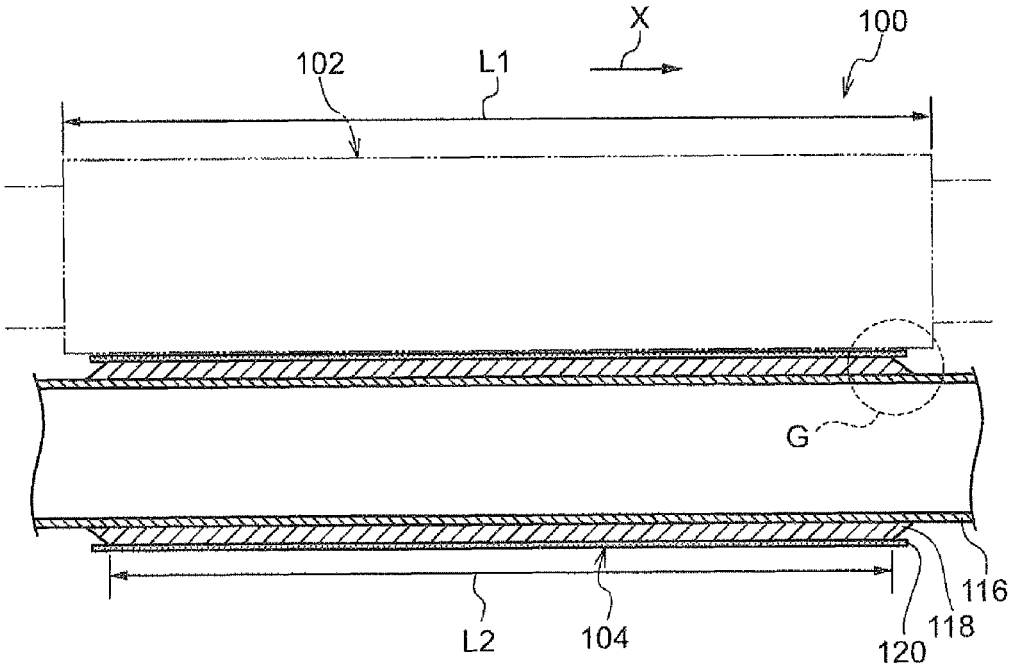
FIG. 3A is a sectional diagram of a pressure roller relating to the exemplary embodiment of the present invention.

FIG. 3A shows a sectional diagram taken along the axial direction of the pressure roller 104 (the direction of arrow X). Here, the axial direction length of the fixing roller 102 (the axial direction length of the resilient layer 110 (see FIG. 2)), indicated by the two-dot chain line, is represented by L1, and the axial direction length of the pressure roller 104 (the axial direction length of a region at which the three layers of the metal core 116, the resilient layer 118 and the surface layer 120 are layered) is represented by L2. Then, L1 is greater than L2.

Figure 3B:
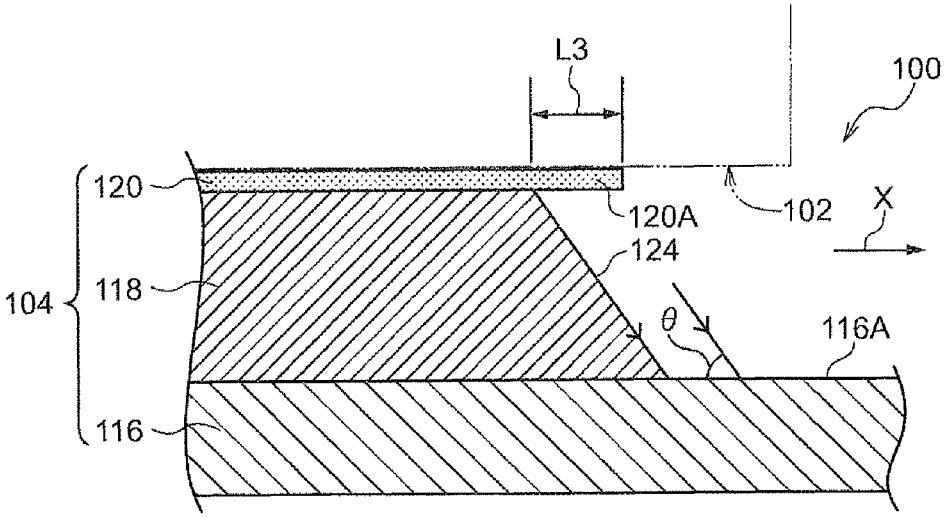
FIG. 3B is a partial sectional diagram of the pressure roller relating to the exemplary embodiment of the present invention.

FIG. 3B shows a magnified diagram of a cross-section region G at one end portion of the pressure roller 104. At each of the two end portions of the resilient layer 118, an inclined end face 124, which is an example of an inclined portion and an end face, is formed, angled such that the axial direction length thereof is longer at the metal core 116 side than at the surface layer 120 side. The inclination angle in a direction relative to an outer peripheral face 116A of the metal core 116 is represented by θ (0°<θ<90°). Thus, the inclined end face 124 is exposed.

Here, it should be noted that the inclination angle θ is defined as an angle at which each inclined end face or an extended plane of each inclined face crosses the metal core. The inclination angle θ may satisfy the relationship 0°<θ<90°, preferably satisfy the relationship 0°<θ<60°, and more preferably satisfy the relationship 30°<θ<50°.

The end portion of the surface layer 120 is an overhang portion 120A that protrudes by a length L3 in the axial direction relative to the resilient layer 118 from a region of close contact with the resilient layer 118. The overhang portion 120A is disposed apart from the inclined end face 124 of the resilient layer 118. The length L3 of the overhang portion 120A is preferably at least 1 mm and at most 10 mm. This is because, if the length L3 of the overhang portion 120A is smaller than 1 mm, then the resilient layer 118 and the fixing roller 102 are likely to come into contact, and if the length is more than 10 mm, then because the surface layer 120, does not back up against the resilient layer 118, it may not be possible for the overhang portion 120A to maintain its attitude (shape) by itself.

Next, operation of the exemplary embodiment of the present invention is described.

Firstly, an image forming process of the image forming device 10 is described.

Image data outputted from an unillustrated image reading device, personal computer or the like is subjected to image processing by an unillustrated image processing device. The image data that has been subjected to image processing is converted to color-separated gradation data of the four colors Y, M, C and K, and outputted to the optical scanning devices 14Y, 14M, 14C and 14K, respectively.

At the optical scanning devices 14Y, 14M, 14C and 14K, the light beams 16Y, 16M, 16C and 16K are irradiated at the photoreceptors 18Y, 18M, 18C and 18K on the basis of the color-separated gradation data that is inputted. The surfaces of the photoreceptors 18Y, 18M, 18C and 18K are charged up by the electrostatic chargers 20Y, 20M, 20C and 20K beforehand, and the surfaces are exposed by the light beams 16Y, 16M, 16C and 16K and electrostatic latent images are formed. The electrostatic latent images that have been formed are developed as toner images of the colors Y, M, C and K by the developers 22Y, 22M, 22C and 22K.

Then, the toner images formed on the photoreceptors 18Y, 18M, 18C and 18K are transferred onto the intermediate transfer belt 28 at the first transfer sections 25. This transfer is implemented by voltages (first transfer biases) of the opposite polarity to the charging polarity of the toners (which is, for example, negative polarity) being applied to the intermediate transfer belt 28 by the first transfer rollers 24Y, 24M, 24C and 24K and the toner images being sequentially superposed on the surface of the intermediate transfer belt 28. Then the toner image is conveyed to the second transfer section 42 by the intermediate transfer belt 28.

The feed roller 52 turns to match a timing at which the toner image is conveyed to the second transfer section 42, and recording paper P of a specified size is fed out from the paper accommodation section 50. The recording paper P that has been fed out by the feed roller 52 is conveyed by the conveyance rollers 54 and 56, passes through the conveyance section 58 and reaches the second transfer section 42. Before reaching the second transfer section 42, the recording paper P is temporarily stopped, and positioning between the position of the recording paper P and the position of the toner image is implemented by a positioning roller (not illustrated) being turned to match a timing of movement of the intermediate transfer belt 28 bearing the toner image.

At the second transfer section 42, the second transfer roller 38 is pressed against the support roller 36, through the intermediate transfer belt 28. The recording paper P that has been conveyed to match the conveyance of the toner image is sandwiched between the intermediate transfer belt 28 and the second transfer roller 38. At this time, a second transfer bias from the electricity supply roller 40 is applied to the support roller 36 and a transfer electric field is formed. Thus, the unfixed toner image that has been carried on the intermediate transfer belt 28 is pressed by the second transfer roller 38 and the support roller 36 and is electrostatically transferred as a unit onto the recording paper P.

Then, the recording paper P onto which the toner image has been transferred, having been separated from the intermediate transfer belt 28, is conveyed to the conveyance belt 60 and is then conveyed to the fixing device 100. The unfixed toner image on the recording paper P that has been conveyed to the fixing device 100 is fixed onto the recording paper P by heating and pressing in the contact portion N of the fixing device 100. After fixing, the recording paper P is ejected in the direction of arrow C and is stacked on the paper stacking section 64. After the transfer onto the recording paper P has been completed, residual toner remaining on the intermediate transfer belt 28 is conveyed to the intermediate transfer belt cleaner 46 in accordance with the turning movement of the intermediate transfer belt 28 and is removed from the intermediate transfer belt 28. In this manner, the image forming device 10 forms images.

Next, operation of the pressure roller 104 is described.

First, operation of a pressure roller 204 provided at a fixing device 200, which is a comparative example with the present exemplary embodiment, is described. The same reference numerals are assigned to members thereof with structures the same as in the fixing device 100 of the present exemplary embodiment, and descriptions thereof are not given.

Figure 4A:
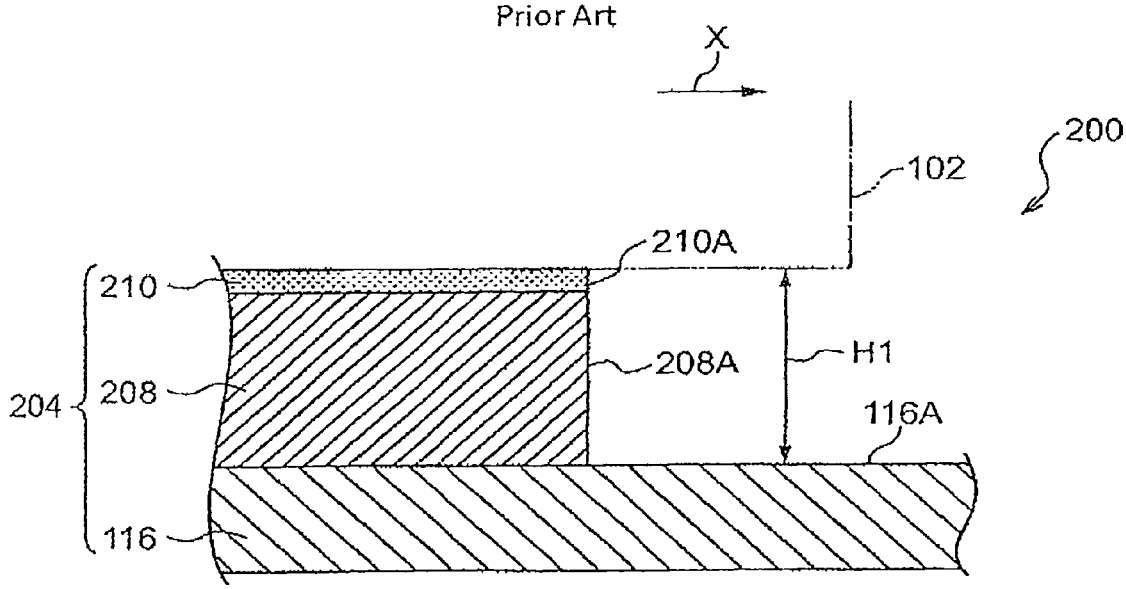
FIG.4A Prior Art
FIG. 4A is a sectional diagram illustrating a state of deformation of a pressure roller of a comparative example.

FIG. 4A shows a sectional diagram of one end portion of the pressure roller 204 of the fixing device 200 that is the comparative example. The fixing device 200 includes the fixing roller 102 and the pressure roller 204. The pressure roller 204 includes the metal core 116, a resilient layer 208 of the same material and thickness as the resilient layer 118 (see FIG. 2), and a surface layer 210 of the same material as the surface layer 120 (see FIG. 2).

End portions of the resilient layer 208 and the surface layer 210 are formed with end faces 208A and 210A which cut across in a direction perpendicular to the axial direction and have axial direction positions at the same position. The axial direction lengths of the resilient layer 208 and the surface layer 210 are the same, and the angles formed between the end faces 208A and 210A and the outer peripheral face 116A of the metal core 116 are both 90°. A distance from the outer peripheral face 116A of the metal core 116 to the outer peripheral face of the surface layer 210 in the direction perpendicular to the axial direction, in a state in which the pressure roller 204 is not pressing against the fixing roller 102, is represented by H1.

Figure 4B:
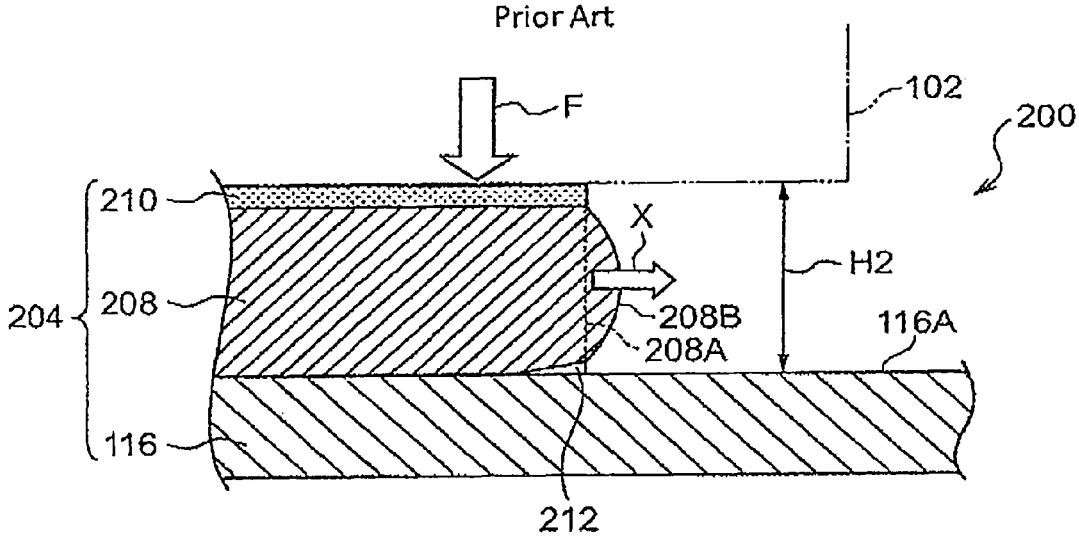
FIG.4B Prior Art
FIG. 4B is a sectional diagram illustrating a state of deformation of the pressure roller of the comparative example.

As illustrated in FIG. 4B, in the fixing device 200 of the comparative example, when the fixing roller 102 and the pressure roller 204 are pressed together and a pressure force F acts in a direction orthogonal to the axial direction of the pressure roller 204, the resilient layer 208 is squashed and the distance from the outer peripheral face 116A of the metal core 116 to the outer peripheral face of the surface layer 210 becomes 112 (<H1).

Now, because the squashed resilient layer 208 is rubber, the volume does not change, and the volume of the squashed portion protrudes to frontward and rearward (in the directions of arrow C, which is the conveyance direction of the recording paper P) of the nipping portion N (see FIG. 2). However, because the resiliency of the surface layer 210 is higher than that of the resilient layer 208, the portions of the resilient layer 208 that are acting to protrude are restrained by the surface layer 210, and the resilient layer 208 acts to release the deformation thereof at the two axial direction end portions. At each end portion of the resilient layer 208, a portion that touches against the metal core 116 and a portion that touches against the surface layer 210 are each restrained by adhesive force (i.e., deformation thereof is restricted). Consequently, the end face 208A of the resilient layer 208 distends in a circular arc-shaped cross-section and forms a curved face 208B. At this time, because the original end face 208A is a vertical face and is not a surface that has width in the axial direction, a large stress acts in the axial direction in the resilient layer 208.

If the fixing device 200 is used for long periods in the state in which the resilient layer 208 is distended in the axial direction, the resilient layer 208 is likely to break at a portion at which the stress is concentrated. Because the resilient layer 208 and the metal core 116 are adhered, the region contacting the metal core 116 in particular (the region with the reference numeral 212 in the drawing) is likely to break first.

At the pressure roller 204, the end faces 208A and 210A of the surface layer 210 and the resilient layer 208 are aligned. Even though the resilient layer 208 distends and the curved face 208B is formed, the surface layer 210 hardly distends at all. Therefore, a portion of the surface of the curved face 208B may touch against the outer peripheral face of the fixing roller 102. In such a case, because the resilient layer 208 is weak against abrasion, the likelihood of breakage becomes even higher.

In the pressure roller 204 of the comparative example, if the end portion of the surface layer 210 were simply protruded to the axial direction outer side relative to the end face of the resilient layer 208, the action of the large stress in the axial direction of the resilient layer 208 might not be suppressed, because the end face 208A is not a surface with width in the axial direction.

Figure 5A:
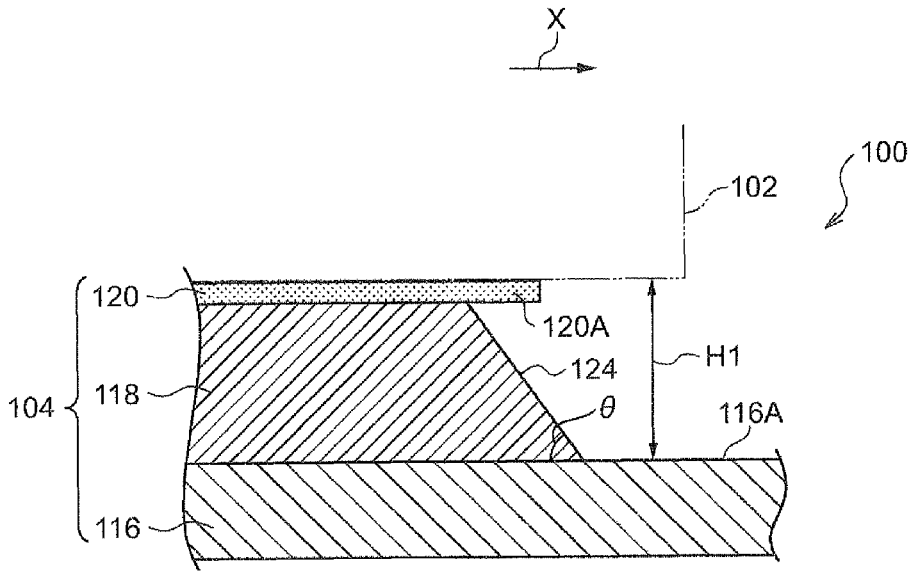
FIG. 5A is a sectional diagram illustrating a state of deformation of the pressure roller relating to the exemplary embodiment of the present invention.

In contrast, in the fixing device 100 of the present exemplary embodiment, as illustrated in FIG. 5A, in the state in which the pressure roller 104 is not pressed against the fixing roller 102, the distance in the direction orthogonal to the axial direction from the outer peripheral face 116A of the metal core 116 to the outer peripheral face of the surface layer 120 is H1 and the angle of inclination of the inclined end face 124 is θ (see FIG. 3B). Therefore, if the resilient layers 118 and 208 are viewed in the axial direction, the inclined end face 124 of the present exemplary embodiment has a larger surface area than the end face 208A of the comparative example (see FIG. 4A).

Figure 5B:
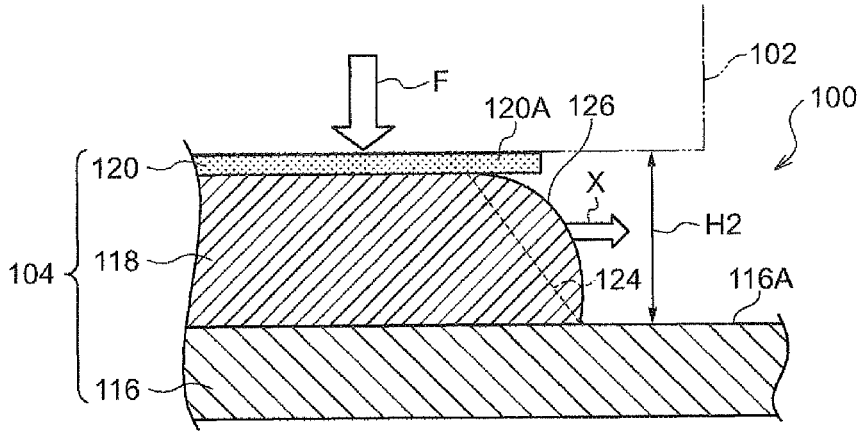
FIG. 5B is a sectional diagram illustrating a state of deformation of the pressure roller relating to the exemplary embodiment of the present invention.

In the fixing device 100 of the present exemplary embodiment, as illustrated in FIG. 5B, when the fixing roller 102 and the pressure roller 104 are pressed together and a pressure force F acts in the direction orthogonal to the axial direction of the pressure roller 104, the resilient layer 118 is squashed and the distance from the outer peripheral face 116A of the metal core 116 to the outer peripheral face of the surface layer 210 becomes H2 (<H1).

The resilient layer 118 squashed by the pressure force F is structured of rubber and the volume thereof does not change.

Therefore, the volume of the squashed portion protrudes to frontward and rearward (in the directions of arrow C, which is the conveyance direction of the recording paper P) of the nipping portion N (see FIG. 2). However, because the resiliency of the surface layer 120 is higher than that of the resilient layer 118, the portions of the resilient layer 118 that are acting to protrude are restrained by the surface layer 120, and the resilient layer 118 acts to release the deformation thereof at the two axial direction end portions. At each end portion of the resilient layer 118, the portion that touches against the metal core 116 and the portion that touches against the surface layer 120 are each restrained by adhesive force. Consequently, the inclined end face 124 of the resilient layer 118 distends in a circular arc-shaped cross-section and forms a curved face 126.

In this case, the original inclined end face 124 of the resilient layer 118 has width in the axial direction too, and the surface area is larger than in the comparative example. Therefore, the axial direction end portion of the resilient layer 118 has greater freedom of deformation than the axial direction end portion of the resilient layer 208 of the comparative example (see FIG. 4B). Therefore, even though portions of the resilient layer 118 are restrained by the metal core 116 and the surface layer 120, deformation of the resilient layer 118 is easier, and a large stress is less likely to concentrate locally.

In the pressure roller 104, because the overhang portion 120A is formed at the end portion of the surface layer 120, even though the resilient layer 118 distends and the curved face 126 is formed, the overhang portion 120A covers the curved face 126. Therefore, no portion of the surface of the curved face 126 touches against the outer peripheral face of the fixing roller 102, and the resilient layer 118 is protected. In addition, because the overhang portion 120A is disposed apart from the inclined end face 124, the overhang portion 120A does not restrict deformation of the inclined end face 124 and stress is unlikely to concentrate in the interior of the resilient layer 118. Even if the overhang portion 120A is reduced in diameter (flexed to the inner side (the metal core 116 side) in FIG. 3B), as long as the overhang portion 120A does not actually adhere to the inclined end face 124, deformation of the resilient layer 118 to protrude to the radial direction outer side relative to the surface layer 120 is suppressed. In this case, the meaning of the state "the overhang portion 120A is disposed apart from the inclined end face 124" includes states up to a state in which the overhang portion 120A and the inclined end face 124 come into contact without adhering.

The present invention is not to be limited to the exemplary embodiment described above.

Figure 6A:
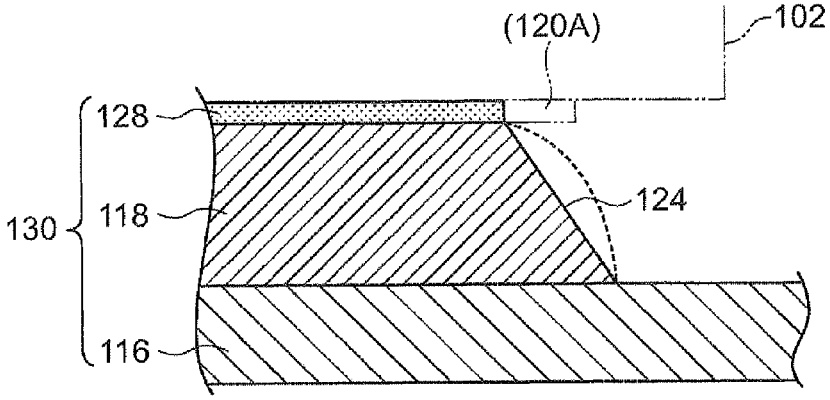
FIG. 6A is a partial sectional diagram of a pressure roller relating to another embodiment of the present invention.

As long as the deformed resilient layer 118 does not touch against the outer peripheral face of the opposing fixing roller, as illustrated in FIG. 6A, a pressure roller 130 that, instead of the surface layer 120 of the pressure roller 104, includes a surface layer 128 from which the overhang portion 120A of the surface layer 120 is removed (see FIG. 3B) may be used.

Figure 6B:
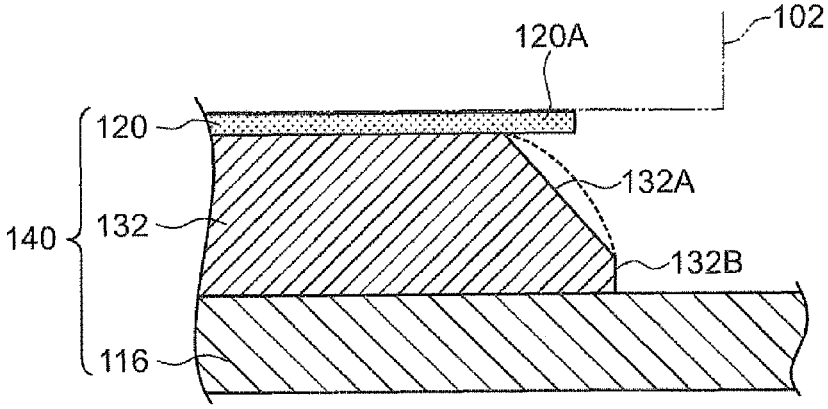
FIG. 6B is a partial sectional diagram of the pressure roller relating to still another embodiment of the present invention.

Further, as illustrated in FIG. 6B, a pressure roller 140 may be used in which, instead of the resilient layer 118 of the pressure roller 104 (see FIG. 3B), the axial direction end face is structured by an inclined end face 132A and a vertical end face 132B. The inclined end face 132A is inclined from the surface layer 120 side, and is an example of the inclined portion. The vertical end face 132B continues from the inclined end face 132A and extends to the metal core 116.

Figure 6C:
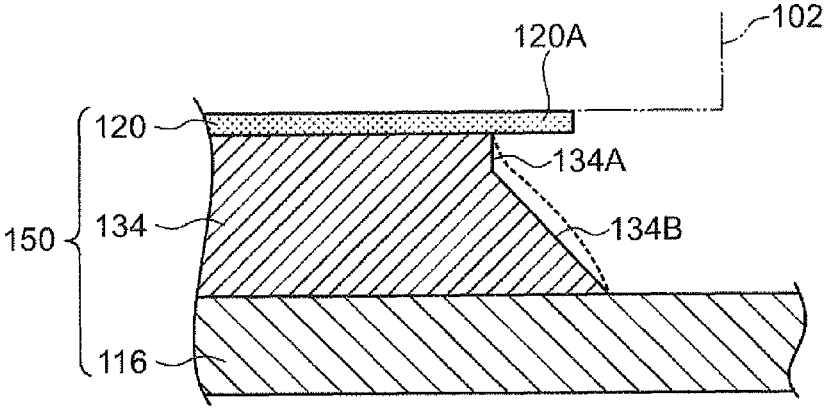
FIG. 6C is a partial sectional diagram of the pressure roller relating to yet another embodiment of the present invention.

Further, as illustrated in FIG. 6C, a pressure roller 150 may be used in which, instead of the resilient layer 118 of the pressure roller 104 (see FIG. 3B), the axial direction end face is structured by a vertical end face 134A and an inclined end face 134B. The vertical end face 134A extends from the surface layer 120 side in the direction orthogonal to the axial direction. The inclined end face 134B continues at an angle from the vertical end face 134A to the metal core 116, and is an example of the inclined portion. Herein, the portions that are illustrated by broken lines in FIG. 6A, FIG. 6B and FIG. 6C represent deformed states of the respective resilient layers 118, 132 and 134.

When there are plural inclined end faces, each of the plural inclined end faces satisfies the relationship $0°<\theta<90°$.

The structures of the inclined end face 124 and the overhang portion 120A may be provided at the fixing roller 102 instead of at the pressure roller 104, and may be provided at both the fixing roller 102 and the pressure roller 104. Similarly, the structures of the inclined end face 124 and the overhang portion 120A may be provided at a pressure belt, a fixing belt or the like instead of at the pressure roller 104, and may be provided at both a pressure belt and a fixing belt. Furthermore, the axial direction length of the fixing roller 102 may be shorter than the axial direction length of the surface layer 120 of the pressure roller 104.

The foregoing description of the embodiments of the present invention has been provided for the purpose of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to practice the particular use contemplated. It is intended that the scope of the invention be defined by the following claims and their equivalents.

What is claimed is:

1. A fixing member to be used in a pressured state, the fixing member comprising:

a base member that is rotated;

a resilient layer adhered to an outer periphery of the base member; and a surface layer adhered to an outer periphery of the resilient layer, wherein an axial direction end face of the resilient layer includes an inclined portion that is inclined such that an axial direction length thereof is longer at the base member side than at the surface layer side, and that is exposed in the axial direction, and the inclined portion constitutes the entire axial direction end face so that the axial direction end face is inclined from the base member to the surface layer.

2. The fixing member according to claim 1, wherein a protruding portion of the surface layer protrudes in the axial direction relative to the resilient layer, and an end portion of the surface layer is disposed apart from the end face of the resilient layer.

3. The fixing member according to claim 1, wherein the inclined portion includes a surface having an inclination angle $\theta$ with respect to an outer peripheral surface of the base member that satisfies the relationship $0°<\theta<90°$.

4. The fixing member according to claim 1, wherein the inclined portion includes a surface having an inclination angle $\theta$ with respect to an outer peripheral surface of the base member that satisfies the relationship $30°<\theta<60°$.

5. The fixing member according to claim 1, wherein the inclined portion includes a surface having an inclination angle $\theta$ with respect to an outer peripheral surface of the base member that satisfies the relationship $30°<\theta<50°$.

6. The fixing member according to claim 2, wherein the length of the protruding portion of the surface layer is from 1 mm to 10 mm.

7. A fixing device comprising:

a heating section that heats a developing agent on a recording medium; and a pressing section that presses the heated developing agent, wherein a fixing member according to claim 1 is provided at at least one of the heating section or the pressing section.

8. The fixing device according to claim 7, wherein the fixing member is provided at the pressing section as a pressure roller.

9. The fixing device according to claim 7, wherein the fixing member is provided at the heating section as a fixing roller.

10. The fixing device according to claim 7, wherein the fixing member is provided at the pressing section as a pressure belt.

11. The fixing device according to claim 7, wherein the fixing member is provided at the heating section as a fixing belt.

12. An image forming device comprising:

a fixing device according to claim 7; and an image forming section that forms an image with the developing agent on a recording medium that is to be conveyed to the fixing device.

13. The fixing member according to claim 1, wherein the inclined portion is formed throughout the thickness of the resilient layer.

14. The fixing member according to claim 2, wherein, in the axial direction, the length of the surface layer including the protruding portion is smaller than the length of the resilient layer including the inclined portion.

15. A fixing member to be used in a pressured state, the fixing member comprising:

a fixing roller that heats a developing agent on a recording medium; and a pressure roller that presses the heated developing agent and opposes the fixing roller, the pressure roller comprising:

a base member that is rotated;

a resilient layer adhered to an outer periphery of the base member; and a surface layer adhered to an outer periphery of the resilient layer, wherein an axial direction end face of the resilient layer includes an inclined portion that is inclined such that an axial direction length thereof is longer at the base member side than at the surface layer side, and that is exposed in the axial direction, the inclined portion constitutes the entire axial direction end face so that the axial direction end face is inclined from the base member to the surface layer, and an axial direction length of the fixing roller is greater than an axial direction length of the surface layer.

16. The fixing member according to claim 1, wherein the resilient layer is integrally adhered to the outer periphery of the base member, and the surface layer is integrally adhered to the outer periphery of the resilient layer.

17. The fixing member according to claim 15, wherein the resilient layer is integrally adhered to the outer periphery of the base member, and the surface layer is integrally adhered to the outer periphery of the resilient layer.

18. The fixing member according to claim 1, wherein the inclined portion inclines linearly.

19. The fixing member according to claim 15, wherein the inclined portion inclines linearly.

* * * * *